US012070648B2

(12) United States Patent
Chiang et al.

(10) Patent No.: US 12,070,648 B2
(45) Date of Patent: Aug. 27, 2024

(54) DUMBBELL WITH QUICK RELEASE STRUCTURE

(71) Applicant: Yih An Exnt. Co., Ltd., Taichung (TW)

(72) Inventors: Chieh-Lung Chiang, Taichung (TW); Chih-Yung Huang, Taichung (TW)

(73) Assignee: Yih An Exnt. Co., Ltd., Taichung (TW)

( * ) Notice: Subject to any disclaimer, the term of this patent is extended or adjusted under 35 U.S.C. 154(b) by 134 days.

(21) Appl. No.: 17/984,354

(22) Filed: Nov. 10, 2022

(65) Prior Publication Data

US 2024/0157188 A1 May 16, 2024

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC . A63B 21/075; A63B 21/078; A63B 21/0724; A63B 23/12; A63B 21/4043; A63B 21/00065; A63B 21/0728; A63B 21/0726; A63B 21/00061; A63B 21/00069; A63B 21/4035
See application file for complete search history.

(56) References Cited

U.S. PATENT DOCUMENTS 46,413 A * 2/1865 Windship ..... A63B 21/075 482/108
5,346,449 A * 9/1994 Schlagel ..... A63B 21/0728 482/107
5,464,379 A * 11/1995 Zarecky ..... A63B 21/0728 482/106
5,628,716 A * 5/1997 Brice ..... A63B 21/0728 482/106
6,387,022 B1 * 5/2002 Smith ..... A63B 65/06 482/106
6,602,169 B1 * 8/2003 Patti ..... A63B 21/0728 482/107
7,001,310 B1 * 2/2006 Brice ..... A63B 21/075 482/106

(Continued)

FOREIGN PATENT DOCUMENTS

TW M627786 U 6/2022

*Primary Examiner* — Garrett K Atkinson
(74) *Attorney, Agent, or Firm* — Best & Flanagan LLP

(57) ABSTRACT

A dumbbell with a quick release structure contains: a handling assembly, two engagement assemblies, multiple counterweights, and two locking elements. The handling assembly includes a handle. A respective one engagement assembly is connected each of two ends of the handle and includes a retainer driven to move toward an engaging position and a disengaging position from the two ends of the handle. A respective one counterweight includes a connection orifice. A respective one locking element includes a screw column and a head disc. When the retainer of the respective one engagement assembly is located at the engaging position, the screw column is screwed with the retainer; when the retainer of the respective one engagement assembly is located at the disengaging position, the screw column is removed from the retainer.

9 Claims, 10 Drawing Sheets

(56) References Cited

U.S. PATENT DOCUMENTS

| | | | | |
|---|---|---|---|---|
| 7,413,533 | B2 * | 8/2008 | Lin | A63B 21/075 482/106 |
| 7,927,264 | B2 * | 4/2011 | Verheem | A63B 15/005 482/110 |
| 8,986,174 | B2 * | 3/2015 | Lien | A63B 21/4049 482/106 |
| 11,759,669 | B2 * | 9/2023 | Lisi | A63B 21/0724 482/107 |
| 2006/0105891 | A1 * | 5/2006 | Cappellini | A63B 21/0726 482/106 |
| 2012/0252641 | A1 * | 10/2012 | Odneal | A63B 21/072 482/108 |
| 2015/0105224 | A1 * | 4/2015 | Odneal | B22D 17/00 164/47 |
| 2016/0175640 | A1 * | 6/2016 | Kempton | A63B 21/0726 482/106 |
| 2017/0189735 | A1 * | 7/2017 | Buikema | A63B 21/0603 |
| 2017/0266480 | A1 * | 9/2017 | Bruni | A63B 21/062 |
| 2023/0173328 | A1 * | 6/2023 | Wu | A63B 21/075 482/107 |
| 2023/0264067 | A1 * | 8/2023 | Wang | A63B 21/0726 482/107 |
| 2023/0285793 | A1 * | 9/2023 | Gresser | F16B 37/0814 |

* cited by examiner

DUMBBELL WITH QUICK RELEASE STRUCTURE

FIELD OF THE INVENTION

The present invention relates to a dumbbell capable of adjusting a weight, and more particularly to the dumbbell which is capable of replacing another counterweights quickly to adjust the weight of the dumbbell easily.

BACKGROUND OF THE INVENTION

A conventional dumbbell capable of adjusting a weight is disclosed in TW Publication No. M627768, and the conventional dumbbell contains two locking shafts screwed with two ends of a handle via multiple counterweights, thus connecting the dumbbell. After rotating the two locking shafts to remove from the two ends of the handle, the multiple counterweights are replaceable to adjust a weight of the dumbbell. Thereafter, the two locking shafts are rotated tightly to fix new counterweights in different weights.

However, it is time-consuming to rotate the two locking shafts loosely to replace the multiple counterweights. In addition, the two locking shafts are rotated reversely after replacing the new counterweights to fix the new counterweights on the two ends of the handle.

The present invention has arisen to mitigate and/or obviate the afore-described disadvantages.

SUMMARY OF THE INVENTION

One aspect of the present invention is to provide a dumbbell with a quick release structure which is capable of overcoming a troublesome adjustment of a weight of the dumbbell.

To obtain above-mentioned aspect, a dumbbell with a quick release structure provided by the present invention contains: a handling assembly, two engagement assemblies, multiple counterweights, and two locking elements, The handling assembly includes a handle. A respective one engagement assembly is connected on each of two ends of the handle, and the respective one engagement assembly includes a retainer driven to move toward an engaging position and a disengaging position from the two ends of the handle. The multiple counterweights are arranged on the two ends of the handling assembly, and a respective one counterweight includes a connection orifice defined thereon. A respective one locking element includes a screw column and a head disc. The screw column of the respective one locking element is received in each of the two ends of the handle via the connection orifice of the respective one counterweight so that the head disc abuts against an outer wall of an outermost counterweight of the multiple counterweights. When the retainer of the respective one engagement assembly is located at the engaging position, the screw column is screwed with the retainer; when the retainer of the respective one engagement assembly is located at the disengaging position, the screw column is removed from the retainer.

Thereby, the dumbbell of the present invention contains the two engagement assemblies and the two locking elements which are fixed on/in the two ends of the handling assembly. The two locking elements are removed from or fixed on the two ends of the handling assembly. After the two locking elements are received in the two ends of the handling assembly, the two locking elements are rotated and the multiple counterweights are replaceable quickly to adjust the weight of the dumbbell easily and quickly.

DETAILED DESCRIPTION OF THE PREFERRED EMBODIMENTS

Figure 1:
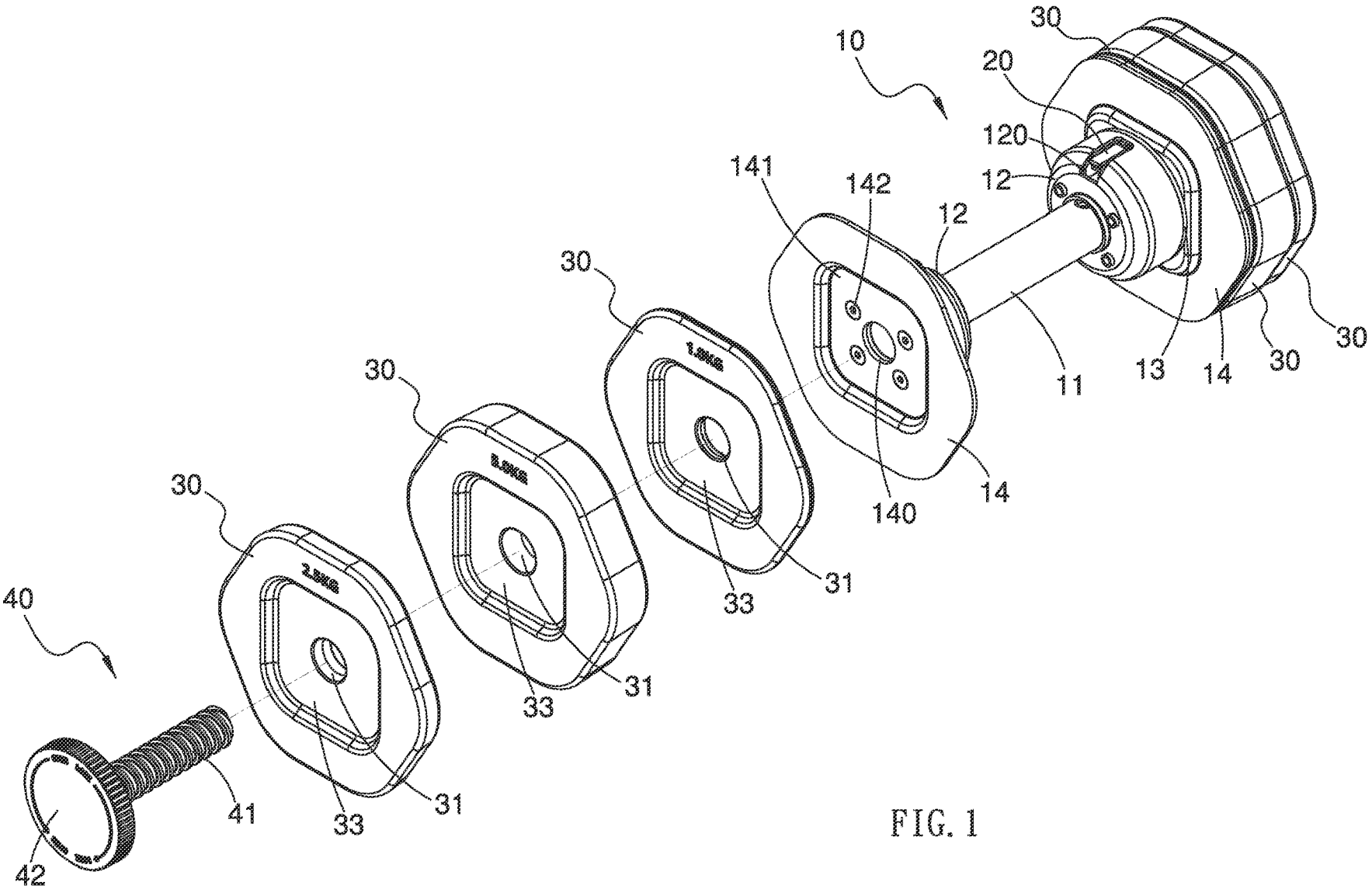
FIG. 1 is a perspective view showing the exploded components of a part of a dumbbell with a quick release structure according to a preferred embodiment of the present invention.
Figure 2:
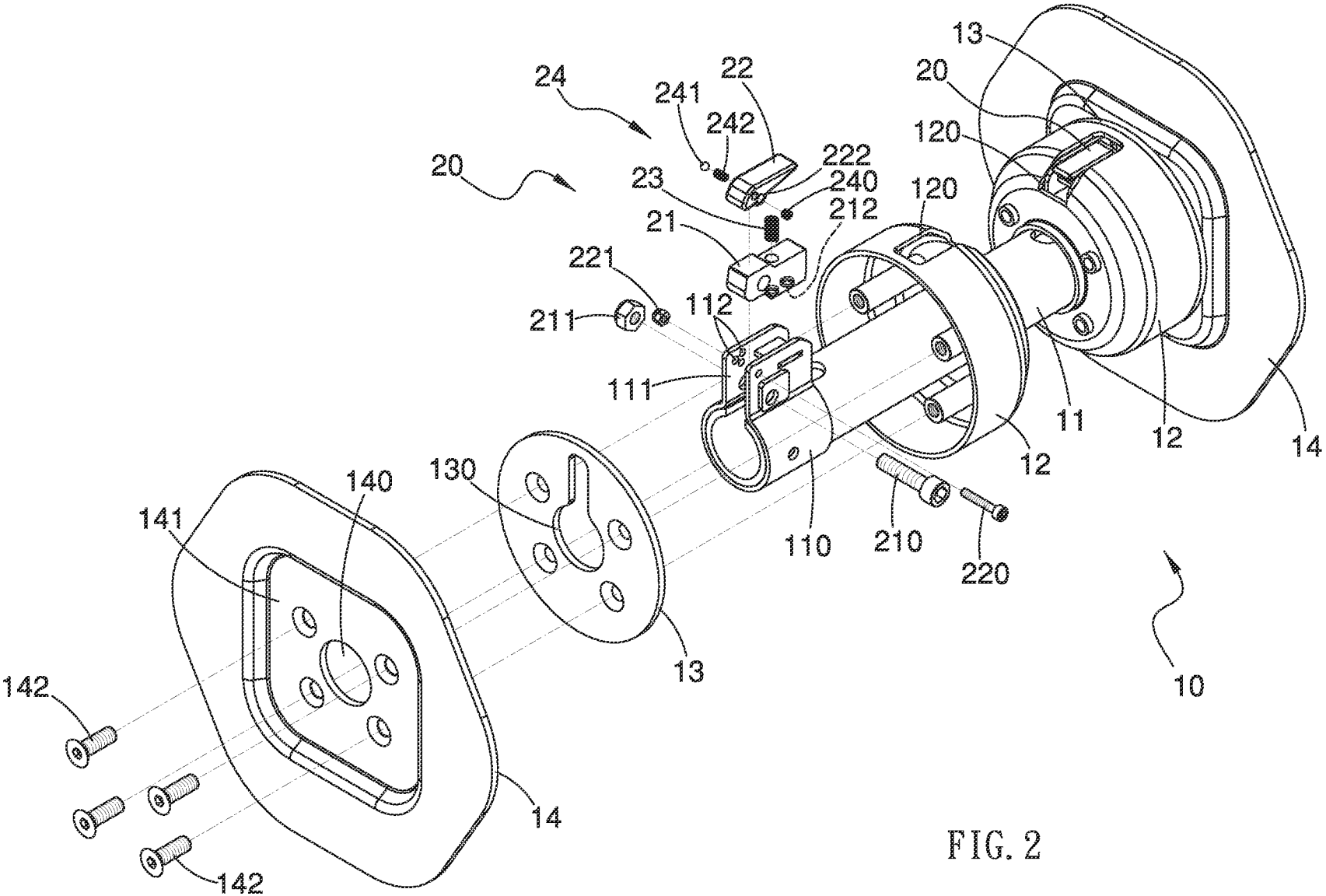
FIG. 2 is an amplified perspective view showing the exploded components of a part of a handling assembly of the dumbbell with the quick release structure according to the preferred embodiment of the present invention.
Figure 3:
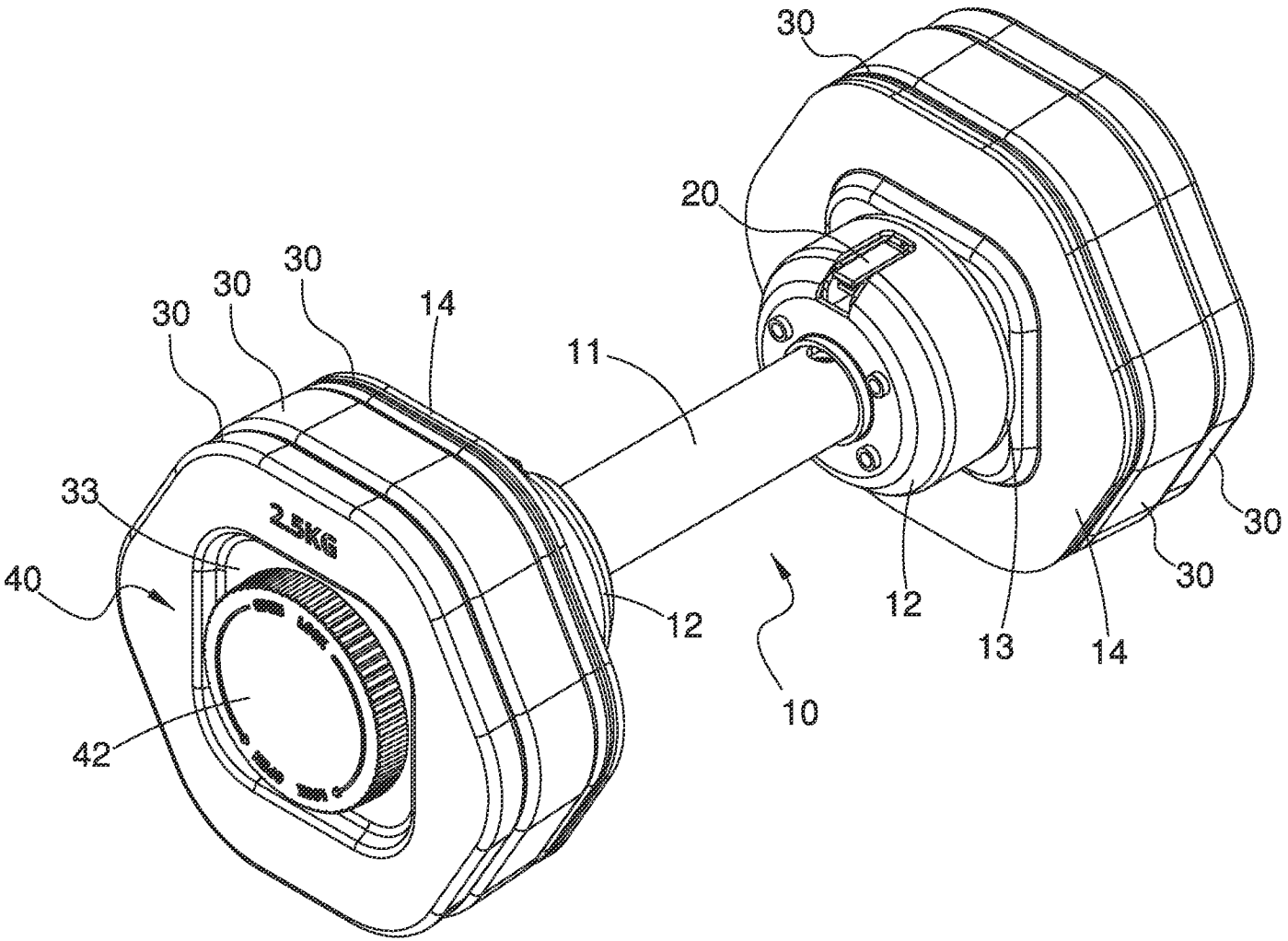
FIG. 3 is a perspective view showing the assembly of the dumbbell with the quick release structure according to the preferred embodiment of the present invention.

With reference to FIGS. 1-5, a dumbbell with a quick release structure according to a preferred embodiment of the present invention comprises: a handling assembly 10, two engagement assemblies 20, multiple counterweights 30, and two locking elements 40.

The handling assembly 10 includes a handle 11, two casings 12, two caps 13, and two abutting sheets 14. The handle 11 is hollowly tubular, and the handle 11 includes two fixers 110 disposed on two ends of the handle 11, and a respective one fixer 110 has a slot 111 defined thereon and a locating orifice 112 formed on each of two walls of the slot 111. A respective one casing 12 is covered on the respective one fixer 110, and the respective one casing 12 has a recess 120 corresponding to the slot 111 of the respective one fixer 110. A respective one cap 13 is covered on the respective one casing 12 and has a through hole 130 corresponding to each of two ends of the handle 11. A respective one abutting sheet 14 is connected on an outer wall of the respective one cap 13 and has a passing orifice 140 corresponding to the through hole 130 of the respective one cap 13, the respective one abutting sheet 14 also has a notch 141 defined on an outer wall thereof. In this embodiment, multiple screw bolts 142 are screwed on the respective one casing 12 via the respective one abutting sheet 14 and the respective one cap 13 so as to connect the respective one abutting sheet 14 on the respective one cap 13.

A respective one engagement assembly 20 is connected on the respective one fixer 110, and the respective one engagement assembly 20 includes a retainer 21, a drive element 22, a resilient element 23, and a positioning set 24. The retainer 21 is rotatably connected in the fixer 110 by using a first coupling shaft 210 and a first screw net 211 so as to be rotated toward an engaging position and a disengaging position in the slot 111 of the respective one fixer 110. The retainer 21 has multiple locking protrusions 212 mounted on a bottom thereof, wherein when the retainer 21 is located at the engaging position, the multiple locking protrusions 212 are located in the handle 11; when the retainer 21 is located at the disengaging position, the multiple locking protrusions 212 are moved upward to a predetermined position. The drive element 22 is rotatably connected in the respective one fixer 110 by way of a second coupling shaft 220 and a second screw net 221 and exposes outside the recess 120 of the respective one casing 12, such that the drive element 22 is pulled to rotate in the slot 111 of the respective one fixer 110, and the retainer 21 is pushed to rotate from the engaging position to the disengaging position in the slot 111 of the respective one fixer 110. The drive element 22 has a receiving orifice 222 horizontally extending thereon, wherein a first end of the resilient element 23 abuts against the retainer 21, and a second end of the resilient element 23 contacts with the respective one fixer 110, such that when the retainer 21 does not abut against the resilient element 23, the retainer 21 rotates from the disengaging position to the engaging position in the slot 111 of the respective one fixer 110. The positioning set 24 is accommodated in the receiving orifice 222 of the drive element 22 of the respective one engagement assembly 20, and the positioning set 24 has a threaded extension 240, a steel ball 241, and an elastic fixing element 242, wherein the threaded extension 240 is screwed in a first end of the receiving orifice 222 of the respective one engagement assembly 20, the steel ball 241 is movably received in a second end of the receiving orifice 222 of the respective one engagement assembly 20, wherein the elastic fixing element 242 is accommodated in the receiving orifice 222, and two ends of the elastic fixing element 242 are biased against the threaded extension 240 so that the elastic fixing element 242 pushes the steel ball 242 to move outward. When the drive element 22 pushes the retainer 21 to move toward the disengaging position, the steel ball 241 is received in one of two locating orifices 112 of each wall of the slot 111 so as to position the drive element 22 at the disengaging position. When the drive element 22 is moved to drive retainer 21 to rotate toward the engaging position, the steel ball 22 is received in the other locating orifice 112 of each wall of the slot 111 so as to position the drive element 21 at the engaging position.

The multiple counterweights 30 are formed in different weights and are arranged outside the two abutting sheets 14, wherein a respective one counterweight 30 includes a connection orifice 31 defined thereon, a defining projection 32 and a groove 33 which are defined on two surfaces of the respective one counterweight 30, wherein the defining projection 32 is engaged in the notch 141 of the respective one abutting sheet 14 or a groove 33 of another respective one counterweight 30. In this embodiment, a defining projection 32 of another respective one counterweight 30 is engaged in the groove 33 of the respective one counterweight 30.

The respective one abutting sheet 14 is hexagonal, and the notch 141 of the respective one abutting sheet 14 is quadrilateral. A profile of the respective one counterweight 30 is hexagonal to correspond to a profile of the respective one abutting sheet 14. A profile of the defining projection 32 of the respective one counterweight 30 is quadrilateral so as to correspond to a profile of the notch 141 of the respective one abutting sheet 14, and the groove 33 is quadrilateral so as to correspond to the profile of the defining projection 32.

The two locking elements 40 are configured to fix the multiple counterweights 30 on two outer walls of the two abutting sheets 14. A respective one locking element 40 includes a screw column 41 and a head disc 42, wherein the screw column 41 is received in each of the two ends of the handle 11 via the connection orifice 31 of the respective one counterweight 30, the passing orifice 140 of the respective one abutting sheet 14, and the through hole 130 of the respective one cap 13 so that the head disc 42 abuts against an outer wall of an outermost counterweight 30 of the multiple counterweights 30. When the retainer 21 is at the engaging position, a threaded section of the screw column 41 is screwed with the multiple locking protrusions 212 of the retainer 21. When the retainer 21 is located at the disengaging position, the multiple locking protrusions 212 of the retainer 21 are disengaged from the threaded section of the screw column 41.

Figure 4:
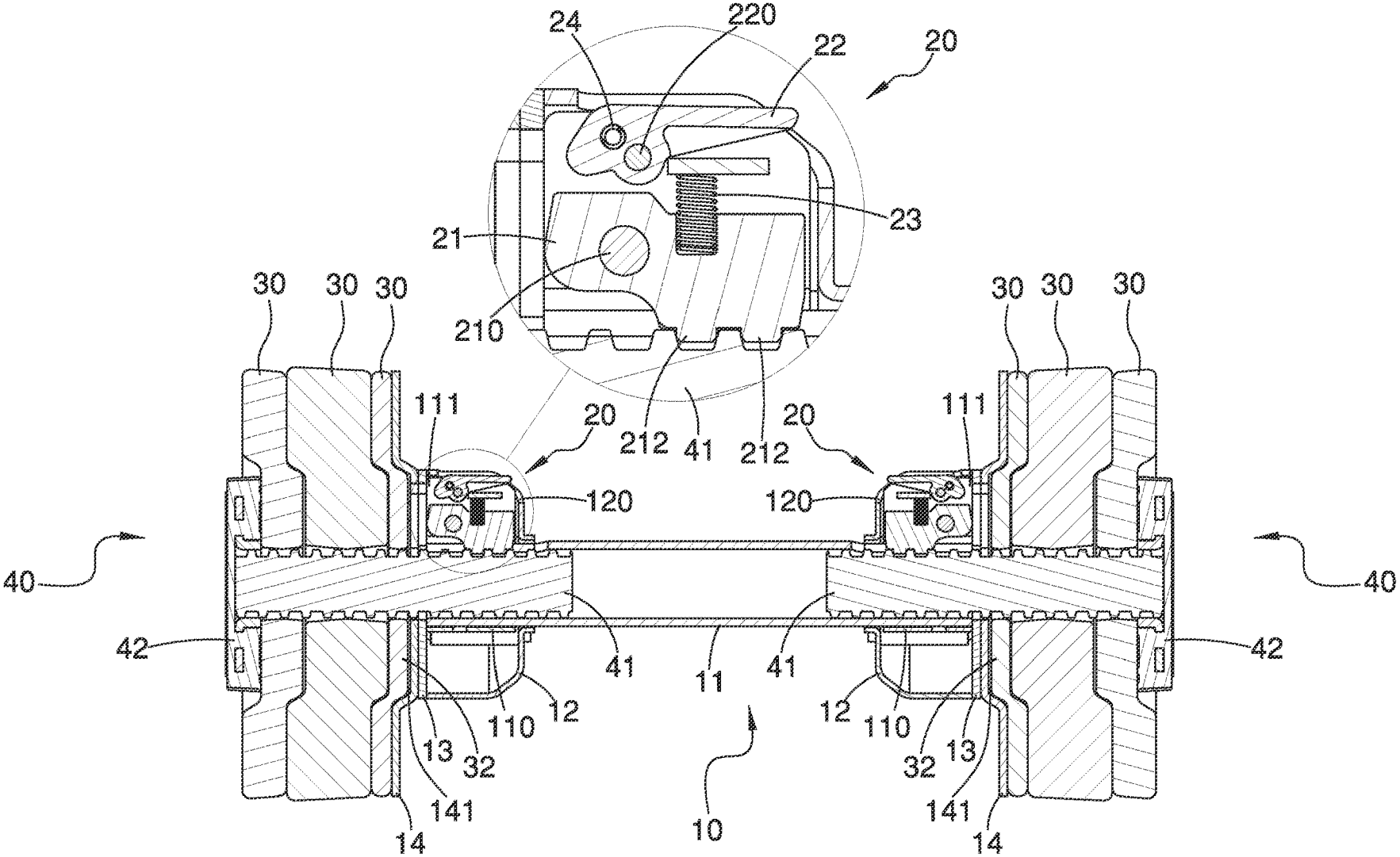
FIG. 4 is an amplified cross-sectional and a cross sectional views showing the assembly of a part of the dumbbell with the quick release structure according to the preferred embodiment of the present invention.
Figure 5:
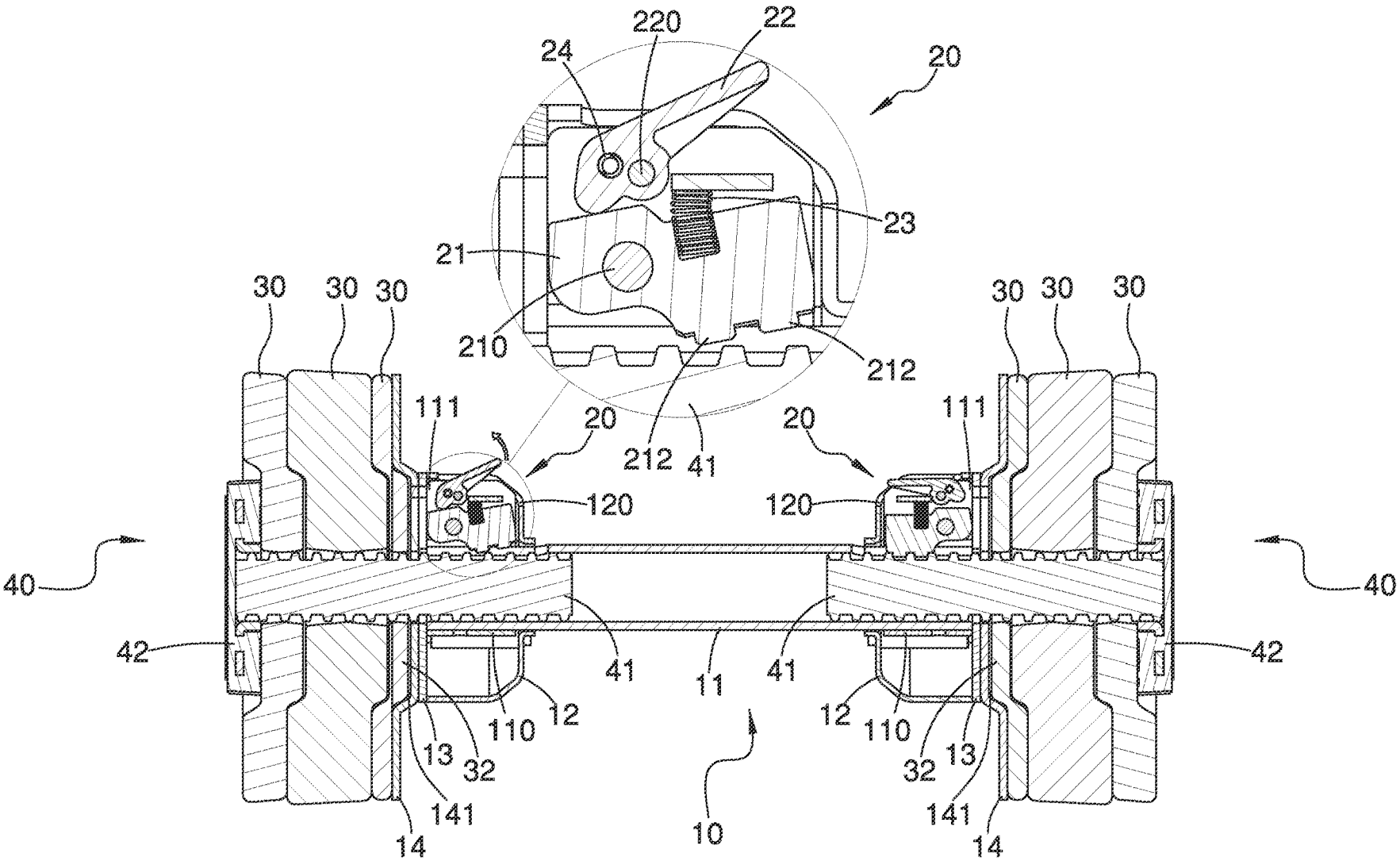
FIG. 5 is a cross sectional view showing the operation of the dumbbell with the quick release structure according to the preferred embodiment of the present invention.
Figure 6:
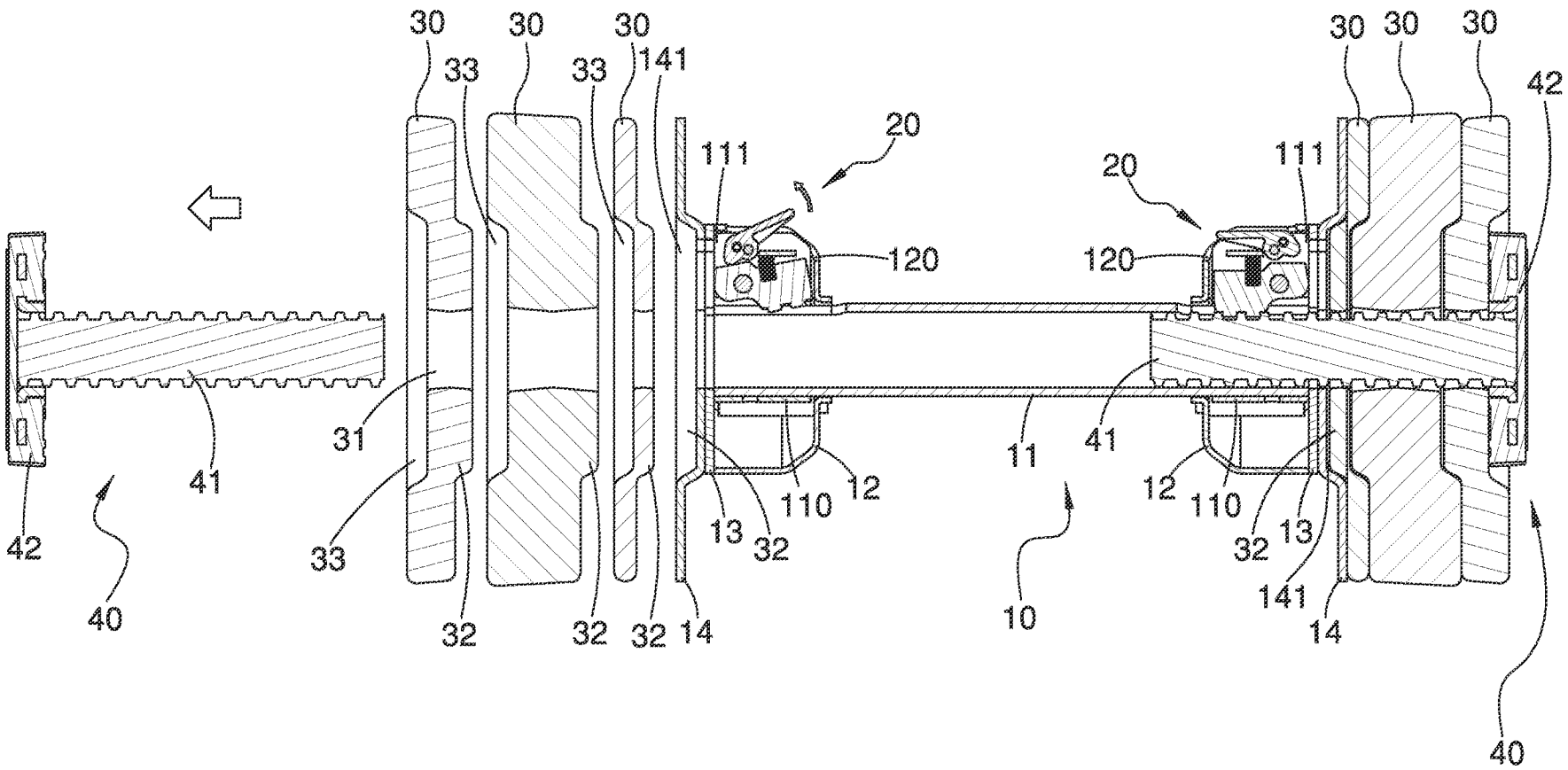
FIG. 6 is another cross sectional view showing the operation of the dumbbell with the quick release structure according to the preferred embodiment of the present invention.

Referring to FIGS. 4-6, the drive element 22 of the respective one engagement assembly 20 is rotated upward, an end of the drive element 22 pushes the retainer 21 to rotate toward the disengaging position from the engaging position in the slot 111 of the respective one fixer 110, such that the multiple locking protrusions 212 of the retainer 21 disengage from the threaded section of the screw column 41 of the respective one locking element 40, and the respective one locking element 40 is removed quickly to disengage the multiple counterweights 30, thus replacing multiple another counterweights 30 easily. When the retainer 21 is located at the disengaging position, the screw column 41 of the respective one locking element 40 is received in the one end of the handle 11 via another counterweights 30, the drive element 22 is rotated downward so that the resilient element 23 pushes the retainer 21 back to the engaging position from the disengaging position, and the multiple locking protrusions 212 of the retainer 21 engage with the threaded section of the screw column 41. Thereafter, the respective one locking element 40 is rotated tightly to adjust a weight of the dumbbell quickly and easily.

Thereby, the dumbbell of the present invention contains the two engagement assemblies 20 and the two locking elements 40 which are fixed on/in the two ends of the handling assembly 10, wherein the two locking elements 40 are removed from or fixed on the two ends of the handling assembly 10, after the two locking elements 40 are received in the two ends of the handling assembly 10, the two locking elements 40 are rotated and the multiple counterweights 30 are replaceable quickly to adjust the weight of the dumbbell easily and quickly.

Figure 7:
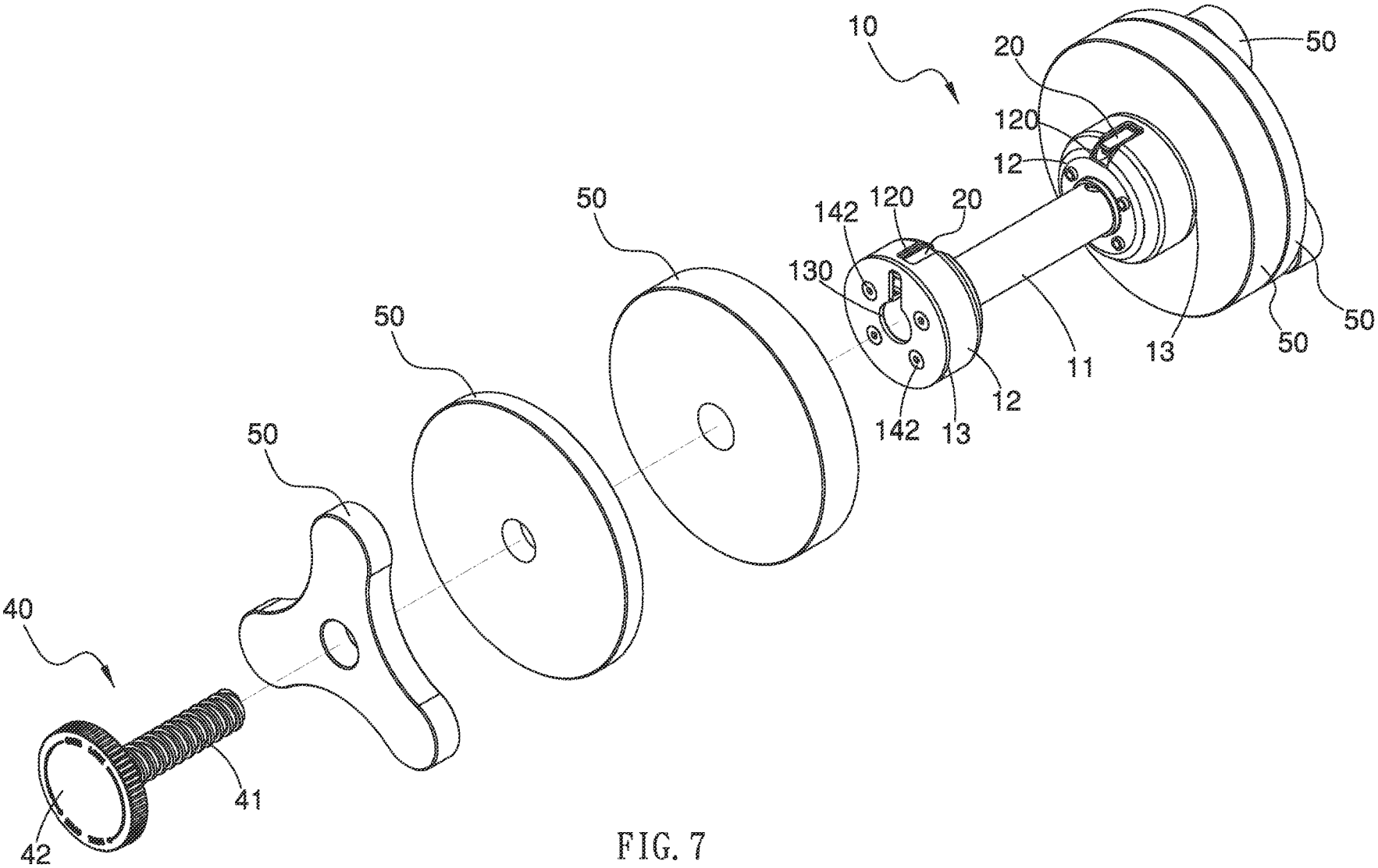
FIG. 7 is a perspective view showing the exploded components of a dumbbell with a quick release structure according to another preferred embodiment of the present invention.

As shown in FIG. 7, in another embodiment, the two abutting sheets 14 are detachable from the handling assembly 10, wherein the multiple screw bolts 142 are configured to fix the respective one cap 13 on the respective one casing 12, and the respective one locking element 40 is fixed on each of the two ends of the handling assembly 10 via multiple counterweights 50 easily.

Figure 8:
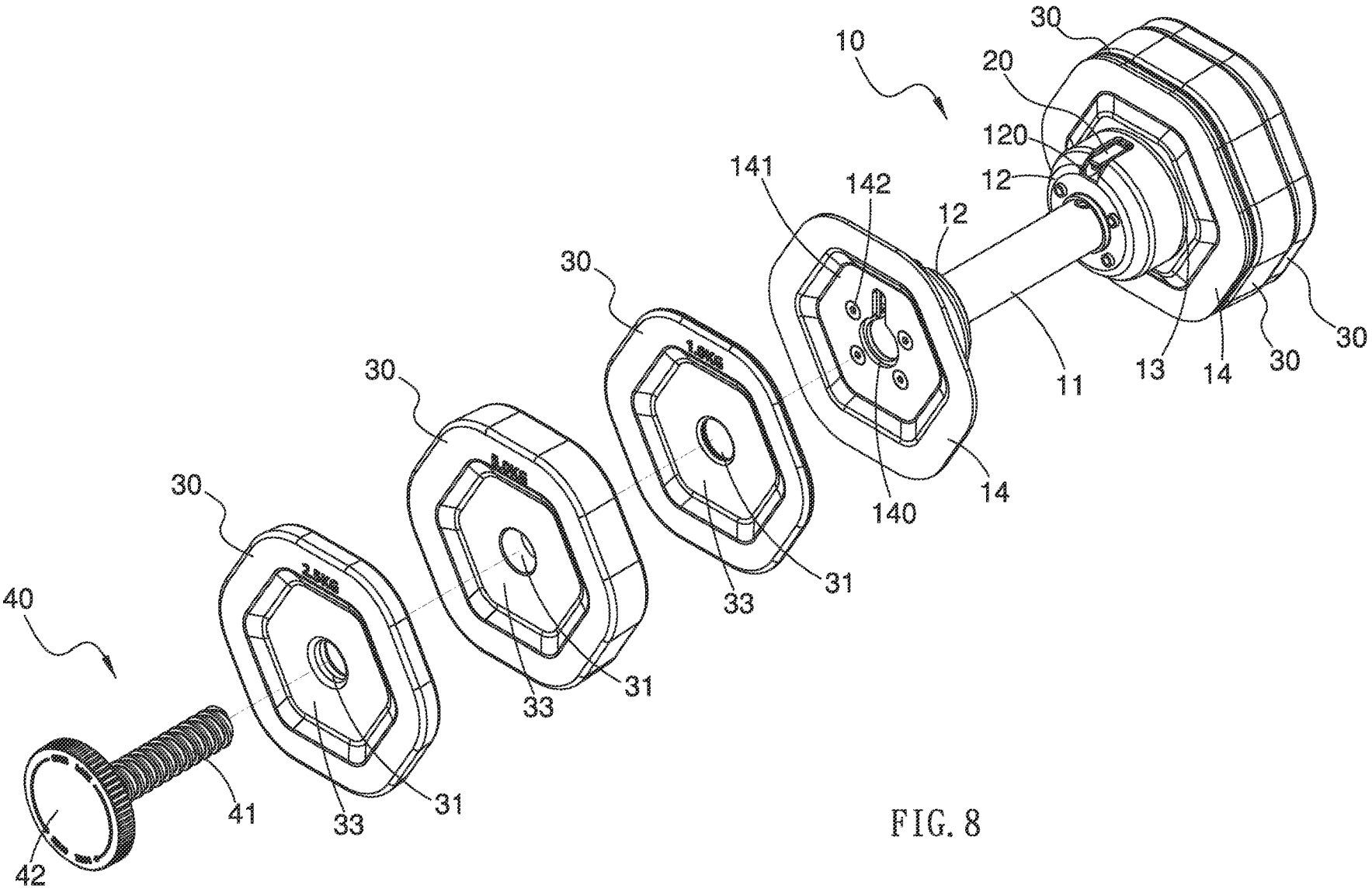
FIG. 8 is an amplified perspective view showing the exploded components of a part of the handling assembly of the dumbbell with the quick release structure according to the preferred embodiment of the present invention.
Figure 9:
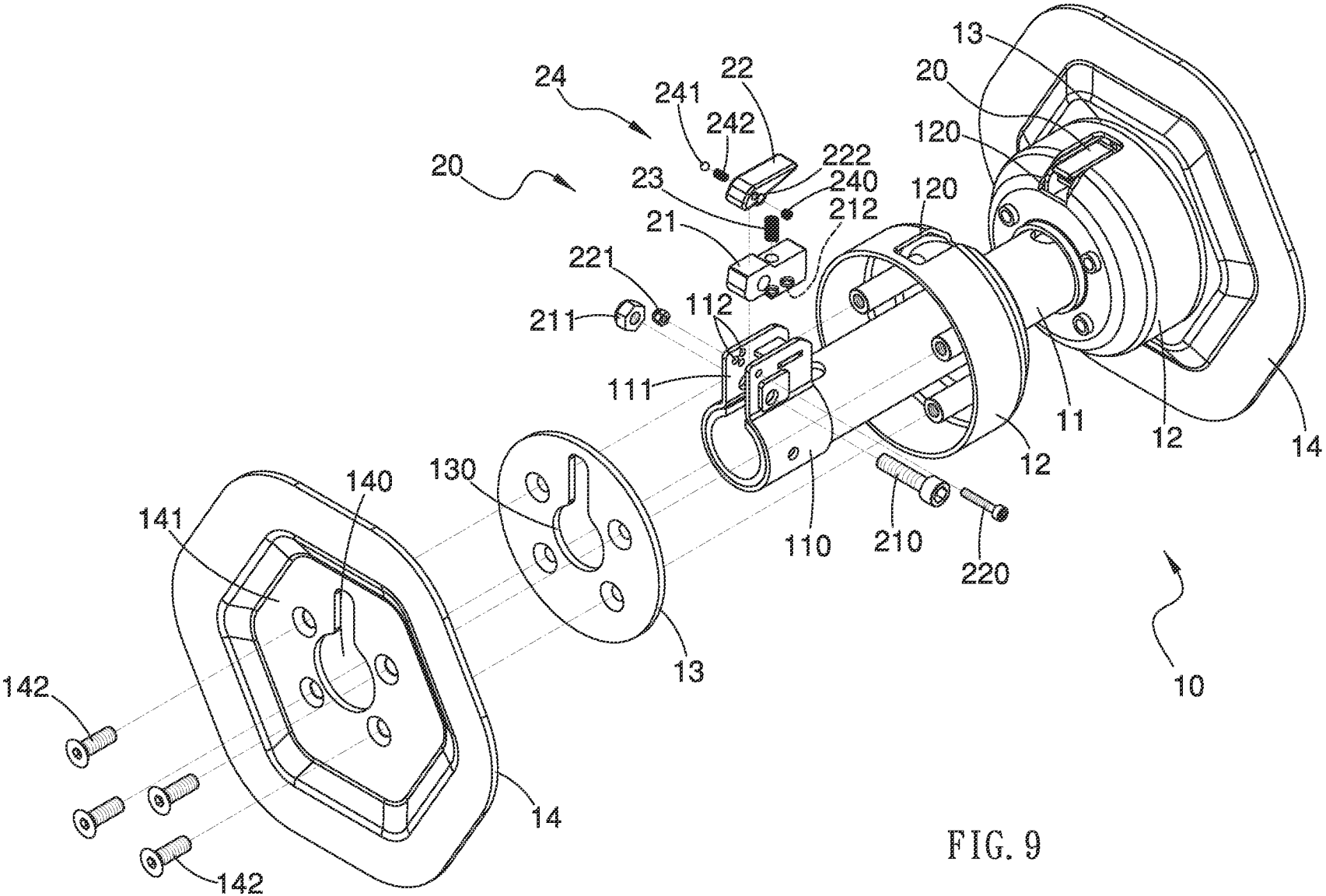
FIG. 9 is an amplified perspective view showing the exploded components of a part of a handling assembly of the dumbbell with the quick release structure according to another preferred embodiment of the present invention.
Figure 10:
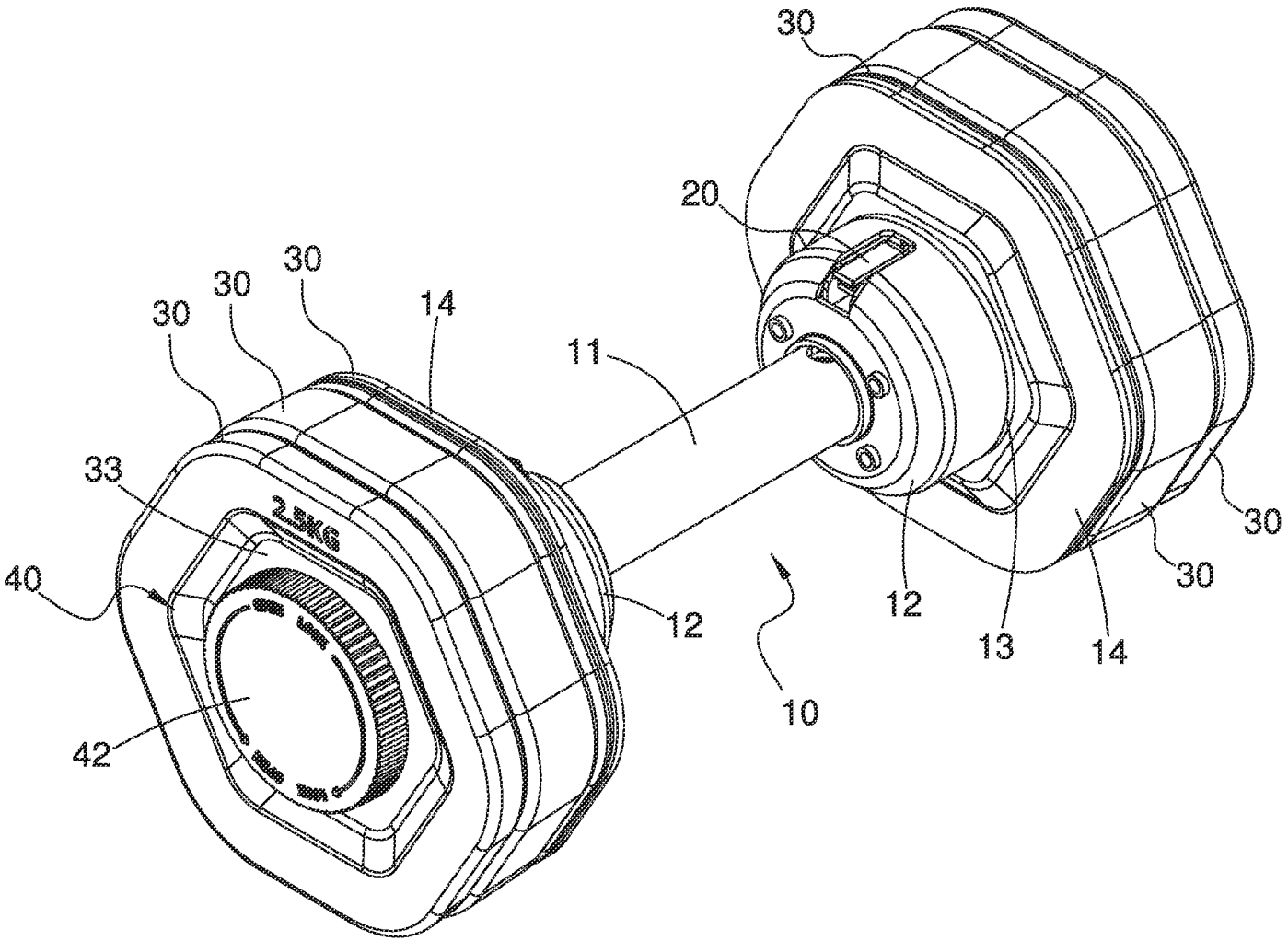
FIG. 10 is a perspective view showing the assembly of a dumbbell with a quick release structure according to another preferred embodiment of the present invention.

As illustrated in FIGS. 8-10, a difference of a dumbbell of this embodiment from above-mentioned embodiments comprises: a profile of the respective one abutting sheet 14 of the two abutting sheets 14 is hexagonal, a profile of the notch 141 of the respective one abutting sheet 14 is hexagonal to correspond to the profile of the respective one abutting sheet 14, a profile of the multiple counterweights 30 is hexagonal to correspond to the profile of the two abutting sheets 14, and the defining projection 32 is hexagonal to correspond to the profile of the notch 141, wherein the groove 33 is hexagonal to correspond to the profile of the defining projection 32, such that the multiple counterweights 30 are fixed adjustably based on using requirements. It is to be noted that the profiles of the respective one abutting sheet 14, the notch 141, the respective one counterweight 30, the defining projection 32 and the groove 33 are formed based on the using requirements.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A dumbbell with a quick release structure comprising:

a handling assembly including a handle;

two engagement assemblies, a respective engagement assembly being connected to each of two ends of the handle, each engagement assembly including a retainer driven to move toward an engaging position and a disengaging position from the two ends of the handle;

multiple counterweights arranged on two ends of the handling assembly, each counterweight including a connection orifice defined thereon;

two locking elements, each locking element including a screw column and a head disc, wherein the screw column of a respective locking element is received in each of the two ends of the handle via the connection orifice of a respective counterweight so that the head disc abuts against an outer wall of an outermost counterweight of the multiple counterweights; and wherein when the retainer of the respective engagement assembly is located at the engaging position, the screw column is screwed with the retainer; when the retainer of the respective engagement assembly is located at the disengaging position, the screw column is removed from the retainer.

2. The dumbbell as claimed in claim 1, wherein the handling assembly includes two casings and two caps, the handle is hollowly tubular, and the handle includes two fixers disposed on the two ends of the handle, and each fixer has a slot defined thereon, wherein a respective casing is covered on each fixer, and each casing has a recess corresponding to the slot of a respective fixer, a respective cap is covered on each casing and has a through hole corresponding to each of the two ends of the handle and configured to receive the screw column of the respective locking element;

a respective engagement assembly is connected on each fixer, each engagement assembly includes a drive element and a resilient element, wherein the drive element is rotatably connected in a respective fixer so that the drive element is configured to rotate toward the engaging position and the disengaging position in the slot of the respective fixer, and the retainer has multiple locking protrusions mounted on a bottom thereof, wherein when the retainer is located at the engaging position, the multiple locking protrusions are located in the handle; when the retainer is located at the disengaging position, the multiple locking protrusions are moved upward to a predetermined position, wherein the drive element is rotatably connected in the respective fixer and exposes outside the recess of the respective one casing, such that the drive element is pulled to rotate in the slot of the respective fixer, and the retainer is pushed to rotate from the engaging position to the disengaging position in the slot of the respective fixer, wherein a first end of the resilient element abuts against the retainer, and a second end of the resilient element contacts with the respective fixer, such that when the retainer does not abut against the resilient element, the retainer rotates from the disengaging position to the engaging position in the slot of the respective fixer;

when the retainer is at the engaging position, a threaded section of the screw column is screwed with the multiple locking protrusions of the retainer, and when the retainer is located at the disengaging position, the multiple locking protrusions of the retainer are disengaged from the threaded section of the screw column.

3. The dumbbell as claimed in claim 2, wherein the handling assembly further includes two abutting sheets, a respective abutting sheet is connected on an outer wall of each cap, each abutting sheet has a passing orifice corresponding to the through hole of the respective cap and configured to receive the screw column of a respective locking element, wherein each abutting sheet also has a notch defined on an outer wall thereof, wherein each counterweight further includes a defining projection and a groove which are defined on two surfaces of each counterweight, wherein the defining projection is engaged in the notch of a respective abutting sheet or a groove of another respective counterweight.

4. The dumbbell as claimed in claim 3, wherein each abutting sheet is hexagonal, and the notch of each abutting sheet is hexagonal, a profile of each counterweight is hexagonal to correspond to a profile of a respective abutting sheet, a profile of the defining projection of each counterweight is hexagonal so as to correspond to a profile of the notch of the respective abutting sheet.

5. The dumbbell as claimed in claim 3, wherein multiple screw bolts are configured to connect the respective abutting sheet on each cap.

6. The dumbbell as claimed in claim 2, wherein each fixer has a locating orifice formed on each of two walls of the slot, and each engagement assembly further includes a positioning set, wherein the drive element has a receiving orifice horizontally extending thereon, the positioning set has a threaded extension, a steel ball, and an elastic fixing element, wherein the threaded extension is screwed in a first end of the receiving orifice of a respective engagement assembly, the steel ball is movably received in a second end of the receiving orifice of the respective engagement assembly, wherein the elastic fixing element is accommodated in the receiving orifice, and two ends of the elastic fixing element are biased against the threaded extension so that the elastic fixing element pushes the steel ball to move outward, wherein when the drive element pushes the retainer to move toward the disengaging position, the steel ball is received in one of two locating orifices of each wall of the slot so as to position the drive element at the disengaging position, and when the drive element is moved to drive retainer to rotate toward the engaging position, the steel ball is received in the other locating orifice of each wall of the slot so as to position the drive element at the engaging position.

7. The dumbbell as claimed in claim 2, wherein multiple screw bolts are configured to fix the respective cap on each casing.

8. The dumbbell as claimed in claim 2, wherein each retainer is rotatably connected in a respective fixer by using a first coupling shaft and a first screw net, and the drive element is rotatably connected in the respective fixer by way of a second coupling shaft and a second screw net.

9. The dumbbell as claimed in claim 1, wherein the multiple counterweights are formed in different weights.

* * * * *